US010006187B2

(12) United States Patent
Roper et al.

(10) Patent No.: US 10,006,187 B2
(45) Date of Patent: Jun. 26, 2018

(54) SEAFLOOR NODULE CONCENTRATING SYSTEM AND METHOD

(71) Applicant: Nautilus Minerals Singapore Pte Ltd, Singapore (SG)

(72) Inventors: Malcolm Leishman Roper, Milton (AU); Sean Michael Plunkett, Milton (AU); John Michael Parianos, Milton (AU); Roland Gunter Berndt, Milton (AU)

(73) Assignee: NAUTILUS MINERALS SINGAPORE PTE LTD, Singapore (SG)

( * ) Notice: Subject to any disclaimer, the term of this patent is extended or adjusted under 35 U.S.C. 154(b) by 0 days. days.

(21) Appl. No.: 14/767,287

(22) PCT Filed: Feb. 11, 2014

(86) PCT No.: PCT/SG2014/000054
§ 371 (c)(1),
(2) Date: Aug. 11, 2015

(87) PCT Pub. No.: WO2014/126535
PCT Pub. Date: Aug. 21, 2014

(65) Prior Publication Data

US 2016/0002879 A1 Jan. 7, 2016

(30) Foreign Application Priority Data

Feb. 12, 2013 (AU) ..... 2013900473

(51) Int. Cl.
*E02F 7/10* (2006.01)
*E02F 3/88* (2006.01)
(Continued)

(52) U.S. Cl.
CPC ..... *E02F 7/10* (2013.01); *B63B 21/66* (2013.01); *B63C 7/00* (2013.01); *B63C 11/52* (2013.01);
(Continued)

(58) Field of Classification Search
CPC ... E02F 3/92; E02F 3/94; E02F 3/9218; E02F 3/9212; E02F 3/88; E02F 3/8875;
(Continued)

(56) References Cited

U.S. PATENT DOCUMENTS 3,697,134 A * 10/1972 Murray ..... E02F 3/88 299/8
4,010,560 A * 3/1977 Diggs ..... E02F 3/082 299/9
(Continued)

FOREIGN PATENT DOCUMENTS

CN 101867869 A 10/2010
SU 1739704 A1 4/1994

OTHER PUBLICATIONS

International Search Report for PCT/SG2014/000054 dated May 1, 2014.

*Primary Examiner* — Robert E Pezzuto
(74) *Attorney, Agent, or Firm* — McDonnell Boehnen Hulbert & Berghoff LLP

(57) ABSTRACT

A seafloor nodule concentrating system is provided. The seafloor nodule concentrating system has a surface vessel and an undersea steering vehicle secured to the surface vessel. The undersea steering vehicle is adapted to be towed by the surface vessel. The seafloor nodule concentrating system also has a nodule collecting apparatus connected to the undersea steering vehicle. The nodule collecting apparatus is located on the seafloor. The seafloor nodule concentrating system also has a position determination device adapted to determine the position of the nodule collecting
(Continued)

apparatus and communicate position information of the nodule collecting apparatus to the undersea steering vehicle and surface vessel.

4 Claims, 4 Drawing Sheets

(51) Int. Cl.

| | |
|---|---|
| ***B63C 7/00*** | (2006.01) |
| ***B63C 11/52*** | (2006.01) |
| ***E21C 50/00*** | (2006.01) |
| ***E02F 5/00*** | (2006.01) |
| ***E02F 7/00*** | (2006.01) |
| ***E02F 1/00*** | (2006.01) |
| ***E02F 7/02*** | (2006.01) |
| ***E02F 9/06*** | (2006.01) |
| ***E02F 9/26*** | (2006.01) |
| ***B63B 21/66*** | (2006.01) |

(52) U.S. Cl.
CPC ..... *E02F 1/00* (2013.01); *E02F 3/88* (2013.01); *E02F 5/006* (2013.01); *E02F 7/005* (2013.01); *E02F 7/023* (2013.01); *E02F 9/062* (2013.01); *E02F 9/262* (2013.01); *E02F 9/264* (2013.01); *E21C 50/00* (2013.01)

(58) Field of Classification Search
CPC ..... E02F 3/8858; E02F 3/082; E02F 3/086; E02F 3/081; E02F 7/10; E02F 5/006; E02F 7/005; E02F 1/00; E02F 7/023; E02F 9/002; E02F 9/262; E02F 9/264; E21C 50/00; B63C 7/00; B63C 11/52
USPC ..... 37/308, 309, 314, 338; 299/8, 9
See application file for complete search history.

(56) References Cited

U.S. PATENT DOCUMENTS

| | | | | |
|---|---|---|---|---|
| 4,042,279 | A | 8/1977 | Asakawa | |
| 4,052,800 | A | 10/1977 | Fuhrboter et al. | |
| 4,141,159 | A | 2/1979 | Morris et al. | |
| 4,232,903 | A | 11/1980 | Welling et al. | |
| 4,368,923 | A * | 1/1983 | Handa | E02F 3/92 299/8 |
| 4,503,629 | A * | 3/1985 | Uchida | E02F 3/88 198/812 |
| 4,685,742 | A | 8/1987 | Moreau | |

* cited by examiner

SEAFLOOR NODULE CONCENTRATING SYSTEM AND METHOD

This application is a US national phase of International Application No. PCT/SG2014/000054 filed on Feb. 11, 2014, which claims priority to Australian Patent Application No. 2013900473 filed on Feb. 12, 2013.

FIELD OF THE INVENTION

The invention relates to a seafloor nodule concentrating system. The invention relates in particular, although not exclusively, to a system and method of mining mineral nodules located on the floor of the deep sea.

BACKGROUND OF THE INVENTION

In various locations in the ocean, and in particular in a large area in the central Pacific Ocean to the South of the Hawaiian Islands, polymetallic nodules exist in a muddy surface layer on the bottom of the deep sea. The size of the nodules varies from pebble size to first size and generally lie in water depths of around 5000 meters.

Since the late 1970's, there have been various attempts to engineer a commercially viable solution to mine the nodules from the deep ocean seafloor.

One prior art solution is described in U.S. Pat. No. 4,042,279. This solution comprises a seafloor nodule recovery vehicle and an ore hoisting system to transport ore from the seafloor nodule recovery vehicle to a surface vessel.

The seafloor nodule recovery vehicle described in U.S. Pat. No. 4,042,279 is of a category of vehicles referred to as benthic sleds. Benthic sleds are typically unable to move under their own power nor do the sleds have the ability to steer. In the system described, the seafloor nodule recovery vehicle and associated ore hoisting system is towed along by the surface vessel and collects nodules from the seafloor adjacent an underside of the recovery vehicle. The nodules, in a slurry, are then pumped from the recovery vehicle to the ore hoisting system, in this case a riser pipe.

The solution described in U.S. Pat. No. 4,042,279 has various disadvantages. Whilst the seafloor nodule recovery vehicle is effective enough in collecting the nodules from the seafloor and communicating the collected nodules to the ore hoisting system, the seafloor nodule recovery vehicle is unable to steer to follow a predetermined path and tends to "snake" as it travels due mostly to drag on, and vortex shedding off, the riser pipe. This effect worsens with increased speed through the water.

In circumstances where the seafloor nodule recovery vessel is operating in depths of around 5000 meters, this inability to maintain a desired path greatly reduces the recovery rate of nodules from the seafloor.

A further disadvantage of the system described in U.S. Pat. No. 4,042,279 is the cost associated with the surface vessel and the ore delivery system. The surface vessel needs to be large enough to have a riser system extending towards the seafloor of a length sufficient to deliver the ore to the surface vessel.

The weight associated with a riser system of this scope is significant and thus the surface vessel needs to be of a size to carry that weight. This leads to very high operating costs in circumstances where the seafloor nodule recovery vessel is only able to recover a relatively small amount of nodules in any given time period.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

OBJECT OF THE INVENTION

It is an object of the invention to overcome or at least alleviate one or more of the above problems and/or provide the consumer with a useful or commercial choice.

Other preferred objects of the present invention will become apparent from the following description.

SUMMARY OF THE INVENTION

In one form, although it need not be the only or indeed the broadest form, the invention resides in a seafloor nodule concentrating system comprising:

a surface vessel;

an undersea steering vehicle secured to the surface vessel, the undersea steering vehicle adapted to be towed by the surface vessel;

a nodule collecting apparatus connected to the undersea steering vehicle, the nodule collecting apparatus located on the seafloor; and a position determination device adapted to determine the position of the nodule collecting apparatus and communicate position information of the nodule collecting apparatus to the undersea steering vehicle and surface vessel.

Suitably, the undersea steering vehicle is adapted to alter the direction of the nodule mining apparatus. Suitably, the undersea steering vehicle is adapted to alter the direction of the nodule collecting apparatus in response to receiving position information of the nodule collecting apparatus from the position determination device.

In another form, the invention resides in a nodule collecting apparatus comprising:

a support member;

two or more nodule collection devices, each nodule collection device being secured to the support member and being adapted to collect ore nodules from the seafloor adjacent an underside thereof and communicate those nodules to an outlet pipe; and a combined outlet pipe adapted to receive the collected ore nodules from the outlet pipe of each nodule collection device and re-deposit the collected nodules on the seafloor in the form of a windrow.

In still a further form, the invention resides in a seafloor mining method including the steps of:

towing a nodule collecting apparatus behind a surface vessel along the seafloor;

determining when the nodule collecting apparatus deviates from a predetermined path;

altering the direction of the nodule collecting apparatus to return the nodule collecting apparatus to the predetermined path.

Preferably, an undersea steering vehicle is disposed between the surface vessel and the nodule collecting apparatus and is adapted to alter the direction of the nodule mining apparatus.

Further features of the invention will become apparent from the following description.

BRIEF DESCRIPTION OF THE DRAWINGS

To assist in understanding the invention and to enable a person skilled in the art to put the invention into practical effect, preferred embodiments of the invention will be described by way of example only with reference to the accompanying drawings, wherein.

DETAILED DESCRIPTION OF THE DRAWINGS

Figure 1:
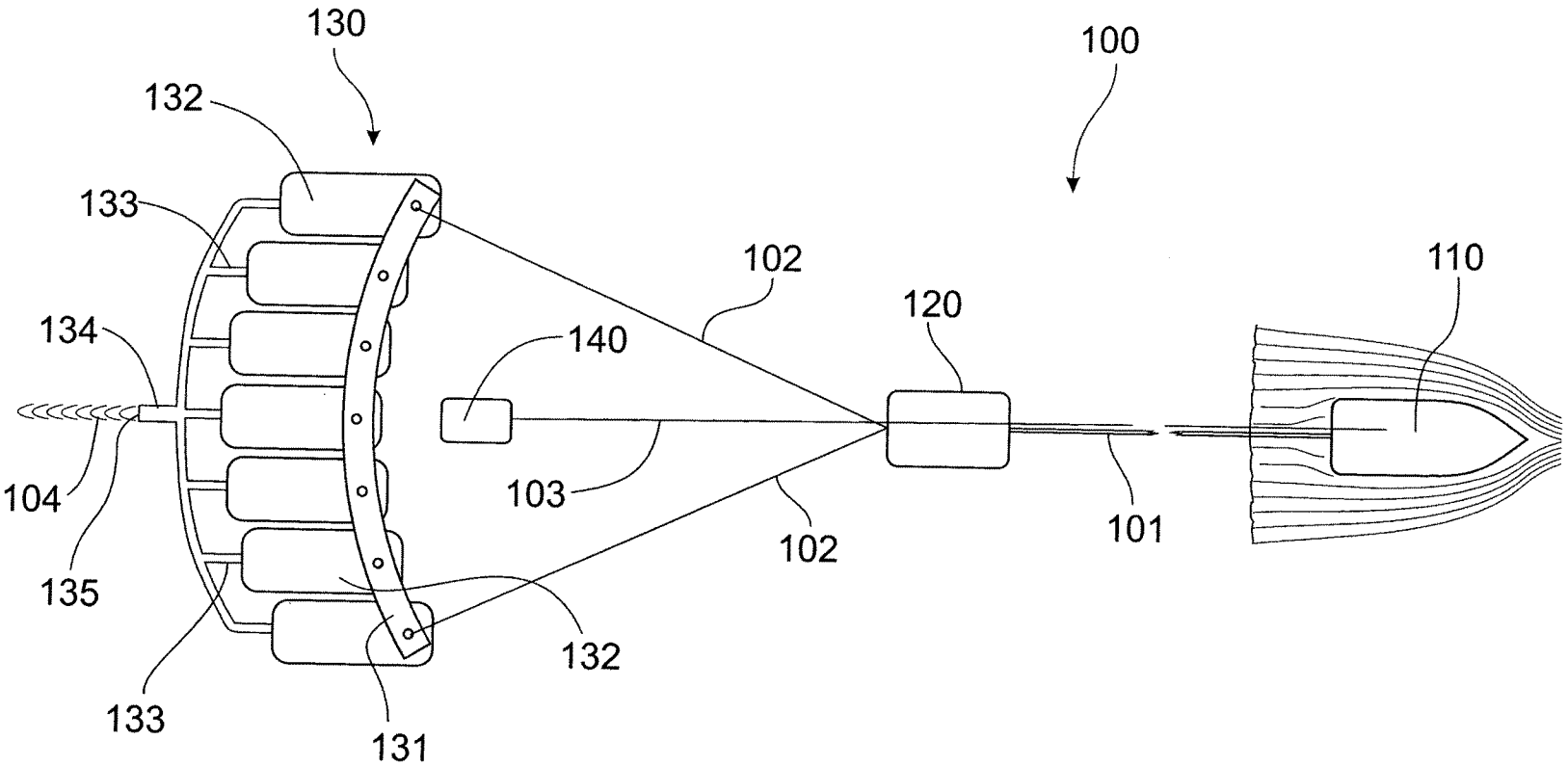
FIG. 1 shows a plan view of a schematic of a seafloor nodule concentrating system according to an embodiment of the invention.
Figure 2:
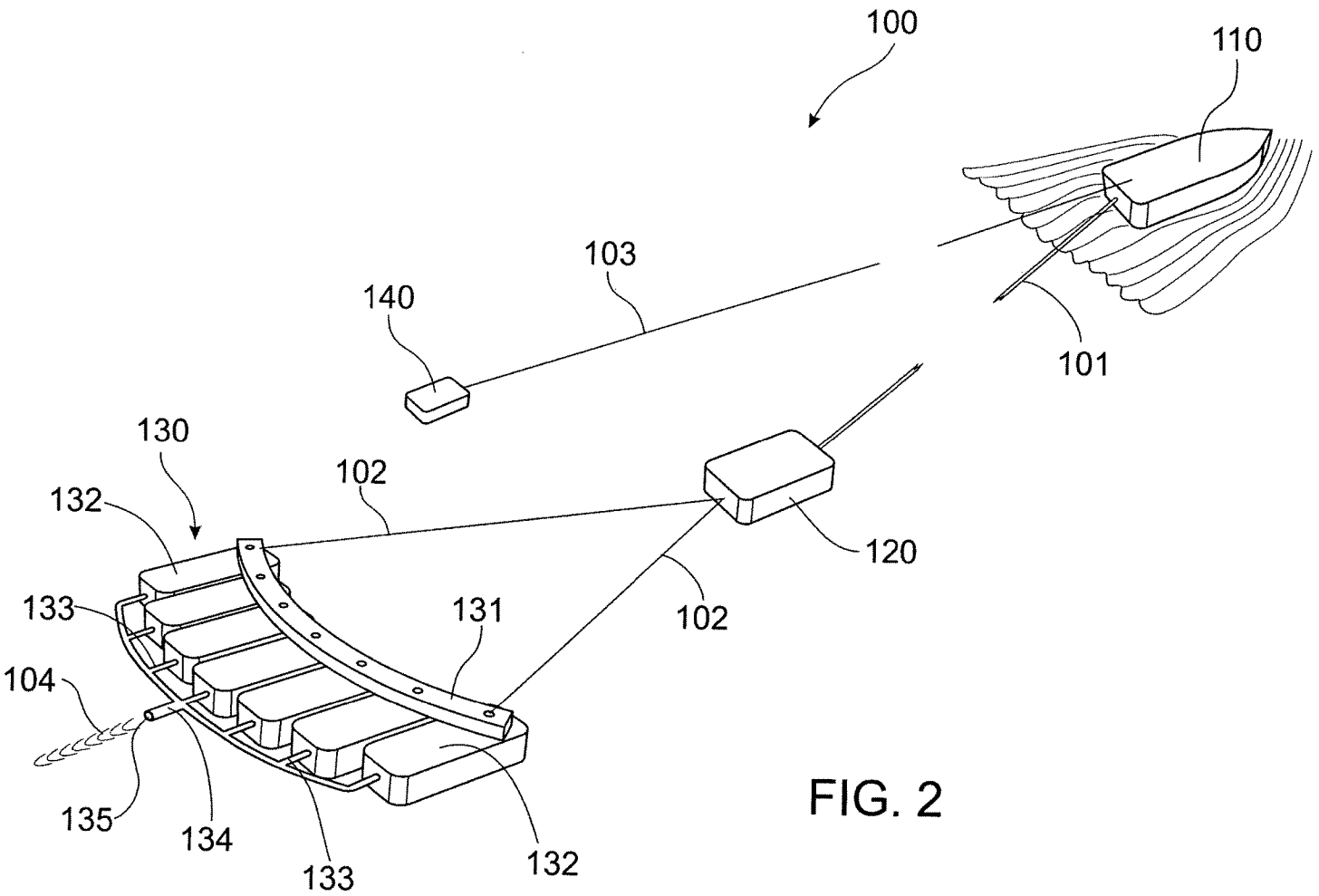
FIG. 2 shows a perspective view of a schematic of a seafloor nodule concentrating system according to an embodiment of the invention.

FIG. 1 shows a plan view of a schematic of a seafloor nodule concentrating system 100 according to an embodiment of the invention and FIG. 2 shows a perspective view of a schematic of the seafloor nodule concentrating system 100.

Seafloor nodule concentrating system 100 has a surface vessel 110, an undersea steering vehicle 120 secured to the surface vessel by way of line 101 and a nodule collecting apparatus 130 secured to the undersea steering vessel 120 by way of lines 102. Seafloor nodule concentrating system 100 further comprises a position determination device 140 secured to surface vessel 110 by way of line 103.

Surface vessel 110 is in the form of a boat, tug or ship. As mentioned previously, undersea steering vehicle 120 is connected to surface vessel 110 by way of line 101 in the form of a heavy duty tow cable or the like.

Undersea steering vehicle 120 is preferably in the form of a Remotely Operated Vehicle (ROV) as is known in the art. ROV's are used extensively in deep sea oil projects and are essentially submarines that are adapted to be operated remotely and/or are programmed to follow a predetermined course.

Undersea steering vehicle 120 is towed by surface vessel 110.

Nodule collecting apparatus 130 is connected to undersea steering vehicle 120 by way of lines 102. Undersea steering vehicle 120 is located proximal nodule collecting apparatus 130 and distal surface vessel 110. By way of example, in circumstances where nodule collecting apparatus 130 is operating in 5000 meters of water, the distance between the surface vessel 110 and the nodule collecting apparatus 130 may be 8000 meters. On that distance, the undersea steering vehicle 120 is preferably positioned about 20 to 100 meters from the nodule collecting apparatus 130.

In the embodiment shown two static cables connect undersea steering vehicle 120 to nodule collecting apparatus 130. Alternative forms may include more cables or even a bridle of cables some of which may feature trim controls via hydraulics or mechanical levers mounted on undersea steering vehicle 120.

In the embodiment shown undersea steering vehicle 120 is suspended in the water several meters to tens of meters above the seabed. Alternative forms may connect the undersea steering vehicle 120 to the seabed via guiding wheels or skids.

In the embodiment shown, nodule collecting apparatus 130 comprises a support member 131 having a plurality of nodule collection devices 132 secured thereto. In a preferred form, each nodule collection device is a benthic sled and functions as described in U.S. Pat. No. 4,042,279.

Each of lines 102 are attached to support member 131 at opposing ends thereof. In the embodiment, support member 131 is arcuate in shape having a concave edge on a leading side thereof and a convex edge on a trailing edge as shown. The support member 131 is preferably in the form of a rigid beam. In a preferred form each nodule collection device 132 is secured to the support member 131 by way of a hinge or spring or the like.

Each nodule collection device 132 has an outlet pipe or hydraulic conveyor 133 attached to an end thereof. Each outlet pipe or hydraulic conveyor 133 is adapted to receive nodules collected adjacent an underside of a respective nodule collection device and communicate those nodules to combined outlet pipe or hydraulic conveyor 134. In preferred form outlet pipe or hydraulic conveyor 133 is attached with a flexible linkage to nodule collection device 132 and outlet pipe or hydraulic conveyor 134 is attached with a flexible linkage to outlet pipe or hydraulic conveyor 133.

In another form outlet pipe or hydraulic conveyor 134 may be integrated or adjoined with support member 131.

Combined outlet pipe or hydraulic conveyor 134 is configured to output the nodules collected by each of the nodule collection devices 132 to the seafloor.

In preferred form water pressure to communicate the nodules along combined outlet pipe or hydraulic conveyor 134 is provided by forward motion of the seafloor concentration system through the water.

Position determination device 140 is connected to surface vessel 110 by way of tow line 103. In the embodiment, position determination device 140 is in the form of a surface towed transponder adapted to communicate with beacons (not shown) located on nodule collecting apparatus 130 to together form an Ultra Short Base Line acoustic position system as is known in the art. In this way, position determination device 140 is adapted to determine the position of nodule collecting apparatus 130 and communicate that position in order to assist in controlling the direction of undersea steering vehicle 120 as will be discussed in greater detail below.

In an alternative embodiment, position determination device 140 may be located on the undersea steering vehicle 120 or indeed on the nodule collecting apparatus 130 and may be in the form of an accelerometer, GNSS system or other similar position determination technology. In such an arrangement, position determination device 140 functions to determine the position of nodule collecting apparatus 130 and communicate that position to undersea steering vehicle 120.

In use, surface vessel 110 tows all of underwater steering vessel 120, nodule collecting apparatus 130 and position determination device 140 along a predetermined path to thereby mine nodules from the seafloor.

As nodule collecting apparatus 130 is towed along, drag on line 101 may cause it to snake as mentioned previously. Position detection device 140 is adapted to detect the position of nodule collecting apparatus 130 as previously discussed. As nodule collecting apparatus 130 moves off the predetermined path, position detection device 140 communicates this event and also the details of that movement to underwater steering vessel 120. Underwater steering vessel 120 consequently adjusts course in order to move nodule collecting apparatus 130 back on to the predetermined path.

Consequently, the seafloor nodule concentrating system 100 of the invention is able to provide for a deep water nodule recovery system that is able to effectively and efficiently recover nodules present on the seafloor by ensuring that recovery may be carried out following predetermined paths. In this way, acceptable amounts of nodules are not left on the seafloor and/or the seafloor mining apparatus is not being towed over seafloor that has already been partly exploited.

As nodule collecting apparatus 130 is towed by the surface vessel 110 along the predetermined path on the seafloor, each of the nodule collection devices 131 collect nodules from the seafloor adjacent to the underside of each nodule collection device and communicate the collected nodules to a respective outlet pipe 133 thereof.

As previously mentioned and in a preferred form, this collection occurs as described in U.S. Pat. No. 4,042,279 which is hereby incorporated by cross reference. In an alternative form, each nodule collection device may be in the form of other types of benthic sleds.

Each of the outlet pipes 133 communicate the collected nodules to combined outlet pipe 134 which then deposits the collected nodules 104 on the seafloor.

As the seafloor mining apparatus tracks across the predetermined pathway on the seafloor, it leaves behind it a windrow of collected nodules in a relatively narrow track as it travels. This then enables another vessel, equipped with an ore hoisting system connected by a tail line to a seafloor recovery apparatus, to lift and transport the collected nodules from seafloor to surface.

This process represents commercial benefits over the known methods of collecting as the large operating costs associated with employing a large vessel having an ore hoisting system attached thereto are used to collect a relatively larger volume of nodules per pass of the surface vessel at a more manageable speed.

FIGS. 3A to 3E show plan views of alternative support members forming part of the nodule collecting apparatus 130.

Figure 3C:
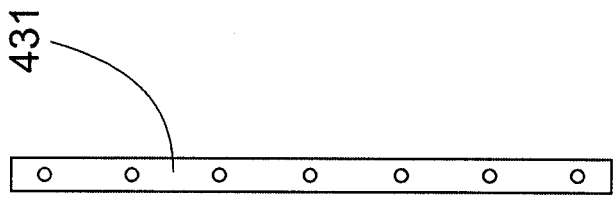
FIG. 3C shows a plan view of an alternative support member forming part of a seafloor recovery apparatus of the seafloor nodule concentrating system shown in FIG. 1.
Figure 3B:
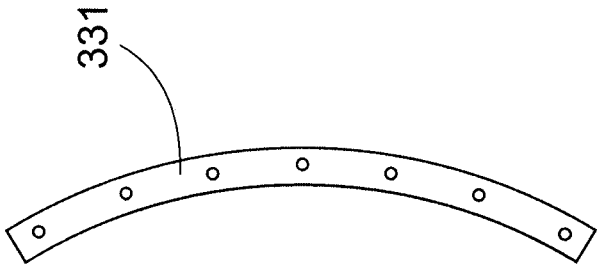
FIG. 3B shows a plan view of an alternative support member forming part of a seafloor recovery apparatus of the seafloor nodule concentrating system shown in FIG. 1.
Figure 3A:
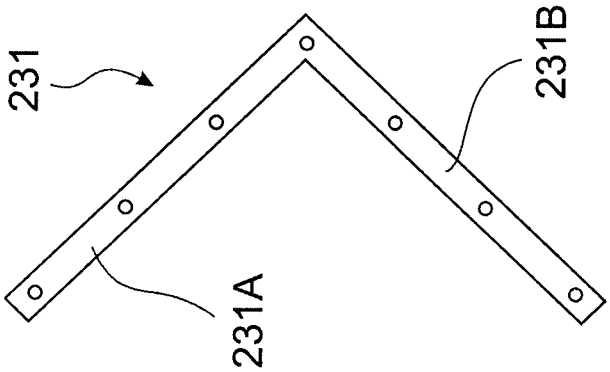
FIG. 3A shows a plan view of a support member forming part of a seafloor recovery apparatus of the seafloor nodule concentrating system shown in FIG. 1.
Figure 3E:
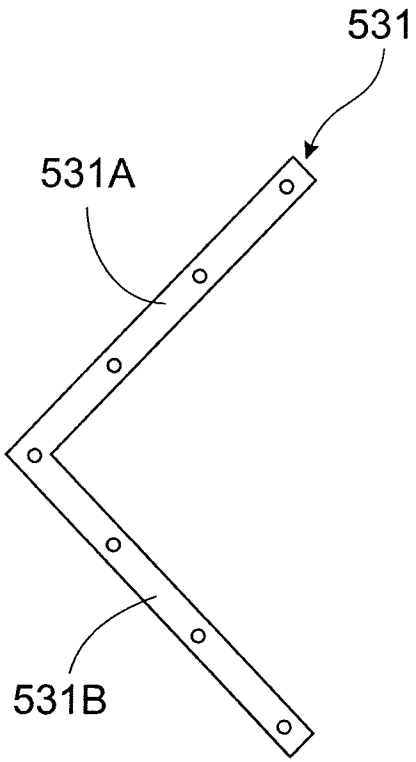
FIG. 3E shows a plan view of an alternative support member forming part of a seafloor recovery apparatus of the seafloor nodule concentrating system shown in FIG. 1.

Support member 231 shown in FIG. 3A is formed from first support member 231A and second support member 2331B arranged at an angle to first support member 231A. In a preferred form that angle is around 90 degrees and support member 231A and 231B form a convex edge on a trailing edge of support member 231.

Support member 331 shown in FIG. 3B is arcuate in shape and has a convex edge on a leading side thereof and a concave edge on a trailing edge.

Support member 431 shown in FIG. 3C is formed from a linear member as shown.

Figure 3D:
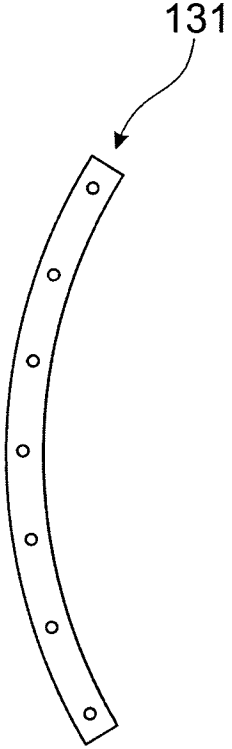
FIG. 3D shows a plan view of an alternative support member forming part of a seafloor recovery apparatus of the seafloor nodule concentrating system shown in FIG. 1.

Support member 131 shown in FIG. 3D is as previously described.

Support member 531 shown in FIG. 3A is formed from first support member 531A and second support member 5331B arranged at an angle to first support member 531A. In a preferred form that angle is around 90 degrees and support member 531A and 531B form a convex edge on a leading edge of support member 531.

Whilst the nodule collecting apparatus 130 is shown with a plurality of nodule collection devices 132, the system and method of seafloor mining 100 may employ a seafloor recovery apparatus that has a single nodule collection device 132, two collection devices 132 or more than two nodule collection devices 132.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The invention claimed is:

1. A seafloor nodule concentrating system comprising:

a surface vessel;

an undersea steering vehicle secured to the surface vessel, the undersea steering vehicle adapted to be towed by the surface vessel;

a nodule collecting apparatus connected to the undersea steering vehicle, the nodule collecting apparatus located on the seafloor; and an electronic position determination device adapted to electronically determine the position of the nodule collecting apparatus and electronically communicate position information of the nodule collecting apparatus to the undersea steering vehicle and surface vessel.

2. The seafloor nodule concentrating system of claim 1, wherein the undersea steering vehicle is adapted to alter the direction of the nodule collecting apparatus in response to electronically receiving position information of the nodule collecting apparatus from the electronic position determination device.

3. The seafloor nodule concentrating system of claim 1, wherein the undersea steering vehicle is located proximal the nodule collecting apparatus.

4. The seafloor nodule concentrating system of claim 1, wherein the undersea steering vehicle is in the form a remotely operated vehicle.

* * * * *